US011167302B2

(12) United States Patent
Fritz et al.

(10) Patent No.: US 11,167,302 B2
(45) Date of Patent: Nov. 9, 2021

(54) COATING DEVICE AND ASSOCIATED OPERATING METHOD

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Moritz Bubek, Ludwigsburg (DE); Timo Beyl, Besigheim (DE); Frank Herre, Oberriexingen (DE); Steffen Sotzny, Oberstenfeld (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 92 days.

(21) Appl. No.: 16/468,692

(22) PCT Filed: Dec. 1, 2017

(86) PCT No.: PCT/EP2017/081099

§ 371 (c)(1),
(2) Date: Jun. 12, 2019

(87) PCT Pub. No.: WO2018/108563

PCT Pub. Date: Jun. 21, 2018

(65) Prior Publication Data

US 2019/0308211 A1 Oct. 10, 2019

(30) Foreign Application Priority Data

Dec. 14, 2016 (DE) ..... 10 2016 014 951.5

(51) Int. Cl.
*B05B 12/08* (2006.01)
*B05B 15/40* (2018.01)
(Continued)

(52) U.S. Cl.
CPC ..... *B05B 12/082* (2013.01); *B05B 12/085* (2013.01); *B05B 12/149* (2013.01);
(Continued)

(58) Field of Classification Search
CPC ... B05B 12/082; B05B 12/085; B05B 12/149; B05B 15/40; B05B 15/58; B05B 15/50
(Continued)

(56) References Cited

U.S. PATENT DOCUMENTS 3,421,694 A 1/1969 Muller
3,717,306 A 2/1973 Hushon et al.
(Continued)

FOREIGN PATENT DOCUMENTS

CN 2287527 Y 8/1998
CN 1331661 A 1/2002
(Continued)

OTHER PUBLICATIONS

Chinese Office Action and Search Report for CN201780077603 3 dated Oct. 12, 2020 (15 pages; English translation not available).
(Continued)

*Primary Examiner* — Steven J Ganey
(74) *Attorney, Agent, or Firm* — Bejin Bieneman PLC

(57) ABSTRACT

The disclosure relates to a coating installation for coating components with a coating agent, in particular for painting motor vehicle body components, with a nozzle applicator, in particular a print head, with at least one nozzle for delivering a coating agent jet of the coating agent onto the component to be coated. The disclosure provides a device for preventing and/or detecting clogging of the nozzle.

38 Claims, 6 Drawing Sheets

(51) Int. Cl.
*B05B 15/58* (2018.01)
*B05B 12/14* (2006.01)
*B05B 15/50* (2018.01)

(52) U.S. Cl.
CPC ..... *B05B 15/40* (2018.02); *B05B 15/50* (2018.02); *B05B 15/58* (2018.02)

(58) Field of Classification Search
USPC ..... 239/104, 106, 112, 119, 71, 69, 575
See application file for complete search history.

(56) References Cited

U.S. PATENT DOCUMENTS 3,981,320 A 9/1976 Wiggins
4,141,231 A 2/1979 Kudlich
4,375,865 A 3/1983 Springer
4,383,264 A 5/1983 Lewis
4,423,999 A 1/1984 Choly
4,430,010 A 2/1984 Zrenner et al.
4,435,719 A 3/1984 Snaper
4,478,241 A 10/1984 Cardenas-Franco
4,555,719 A 11/1985 Arway et al.
4,668,948 A 5/1987 Merkel
4,734,711 A 3/1988 Piatt et al.
4,826,135 A 5/1989 Mielke
4,894,252 A 1/1990 Bongen et al.
4,941,778 A 7/1990 Lehmann
4,974,780 A 12/1990 Nakamura et al.
4,985,715 A 1/1991 Cyphert et al.
5,050,533 A 9/1991 Zaber
5,072,881 A * 12/1991 Taube, III ..... B05B 15/557 239/112
5,429,682 A 7/1995 Harlow, Jr. et al.
5,435,884 A 7/1995 Simmons et al.
5,538,221 A 7/1996 Joswig
5,556,466 A 9/1996 Martin et al.
5,602,575 A 2/1997 Pauly
5,636,795 A 6/1997 Sedgwick et al.
5,647,542 A * 7/1997 Diana ..... B05B 5/1641 239/112
5,659,347 A 8/1997 Taylor
5,681,619 A 10/1997 Ogasawara
5,740,967 A 4/1998 Simmons et al.
5,843,515 A 12/1998 Crum et al.
5,951,882 A 9/1999 Simmons et al.
5,964,407 A 10/1999 Sandkleiva
5,976,343 A 11/1999 Schlaak
6,179,217 B1 1/2001 Osamu et al.
6,540,835 B2 4/2003 Byung-Jo et al.
6,607,145 B1 8/2003 Silvano et al.
6,641,667 B2 11/2003 Ochiai et al.
6,712,285 B2 3/2004 Provenaz et al.
6,777,032 B2 8/2004 Ogasahara et al.
6,811,807 B1 11/2004 Zimmermann et al.
6,849,684 B2 2/2005 Poppe et al.
7,160,105 B2 1/2007 Edwards
7,178,742 B2 2/2007 Nellentine et al.
7,182,815 B2 2/2007 Katagami et al.
7,244,310 B2 7/2007 Edwards
7,270,712 B2 9/2007 Edwards
7,357,959 B2 4/2008 Bauer
7,387,071 B2 6/2008 Heinke et al.
7,449,070 B2 11/2008 Fellingham
7,604,333 B2 10/2009 Horsnell
7,757,632 B2 7/2010 Edwards
7,837,071 B2 11/2010 Achrainer
7,901,741 B2 3/2011 Katagami et al.
8,028,651 B2 10/2011 Rademacher et al.
8,118,385 B2 2/2012 Van De Wynckel et al.
8,449,087 B2 5/2013 Kataoka et al.
8,545,943 B2 10/2013 Frankenberger et al.
8,652,581 B2 2/2014 Merchant
8,678,535 B2 3/2014 Beier et al.
8,875,655 B2 11/2014 Pettersson et al.
8,882,242 B2 11/2014 Beier et al.
9,108,424 B2 8/2015 Wallsten et al.
9,140,247 B2 9/2015 Herre et al.
9,156,054 B2 10/2015 Ikushima
9,266,353 B2 2/2016 Beier et al.
9,393,787 B2 7/2016 Ikushima
9,464,573 B2 10/2016 Remy et al.
9,592,524 B2 3/2017 Fritz et al.
9,701,143 B2 7/2017 Ikushima
9,707,585 B2 * 7/2017 Reimert ..... B05B 12/149
9,844,792 B2 12/2017 Pettersson et al.
9,901,945 B2 * 2/2018 Fehr ..... F04B 53/10
9,914,150 B2 3/2018 Pettersson et al.
10,016,977 B2 7/2018 Stefani et al.
10,105,946 B2 10/2018 Nakamura et al.
10,150,304 B2 12/2018 Herre et al.
10,252,552 B2 4/2019 Pitz et al.
10,272,677 B2 4/2019 Stefani et al.
10,532,569 B2 1/2020 Wallsten et al.
2001/0017085 A1 8/2001 Kubo et al.
2001/0019340 A1 9/2001 Kubo et al.
2002/0024544 A1 2/2002 Codos
2002/0043280 A1 4/2002 Ochiai et al.
2002/0043567 A1 4/2002 Provenaz et al.
2002/0105688 A1 8/2002 Katagami et al.
2002/0128371 A1 9/2002 Poppe et al.
2003/0020783 A1 1/2003 Sanada
2003/0041884 A1 3/2003 Bahr
2003/0049383 A1 3/2003 Toshifumi et al.
2004/0028830 A1 2/2004 Bauer
2004/0089234 A1 5/2004 Hagglund et al.
2004/0123159 A1 6/2004 Kerstens
2004/0173144 A1 9/2004 Edwards
2004/0221804 A1 11/2004 Zimmermann et al.
2004/0231594 A1 11/2004 Edwards
2004/0238522 A1 12/2004 Edwards
2004/0256501 A1 12/2004 Mellentine et al.
2004/0261700 A1 12/2004 Edwards
2005/0000422 A1 1/2005 Edwards
2005/0015050 A1 1/2005 Mowery et al.
2005/0016451 A1 1/2005 Edwards
2005/0023367 A1 2/2005 Reighard et al.
2005/0243112 A1 11/2005 Shinya et al.
2006/0061613 A1 3/2006 Fienup et al.
2006/0068109 A1 3/2006 Frankenberger et al.
2006/0146379 A1 7/2006 Katagami et al.
2006/0238587 A1 10/2006 Horsnell
2006/0251796 A1 11/2006 Fellingham
2007/0062383 A1 3/2007 Gazeau
2007/0292626 A1 12/2007 Larsson et al.
2008/0271674 A1 11/2008 Rademarcher
2008/0309698 A1 12/2008 Nakano et al.
2009/0027433 A1 1/2009 Van De Wynckel et al.
2009/0029069 A1 1/2009 Edwards
2009/0181182 A1 7/2009 Sloan
2010/0132612 A1 6/2010 Johann
2010/0156970 A1 6/2010 Ikushima
2010/0170918 A1 7/2010 Achrainer
2010/0279013 A1 11/2010 Frankenberger et al.
2010/0282283 A1 11/2010 Bauer
2010/0321448 A1 12/2010 Buestgens et al.
2011/0014371 A1 1/2011 Herre et al.
2011/0084150 A1 4/2011 Merchant
2011/0248046 A1 10/2011 Simion
2011/0262622 A1 10/2011 Herre
2012/0085842 A1 4/2012 Ciardella
2012/0105522 A1 5/2012 Wallsten
2012/0114849 A1 5/2012 Melcher
2012/0162331 A1 6/2012 Kataoka
2012/0186518 A1 7/2012 Herre
2012/0219699 A1 8/2012 Pettersson et al.
2012/0249679 A1 10/2012 Beier et al.
2012/0282405 A1 11/2012 Herre
2013/0201243 A1 8/2013 Yoshida
2013/0215203 A1 8/2013 Chen
2013/0257984 A1 10/2013 Beier et al.
2013/0284833 A1 10/2013 Fritz et al.
2014/0076985 A1 3/2014 Pettersson et al.
2014/0242285 A1 8/2014 Pettersson et al.
2015/0009254 A1 1/2015 Kaiba et al.

(56) References Cited

U.S. PATENT DOCUMENTS

| | | | |
|---|---|---|---|
| 2015/0042716 | A1 | 2/2015 | Beier et al. |
| 2015/0086723 | A1 | 3/2015 | Bustgens |
| 2015/0098028 | A1 | 4/2015 | Ohnishi |
| 2015/0328654 | A1 | 11/2015 | Schwab |
| 2015/0375258 | A1 | 12/2015 | Fritz et al. |
| 2015/0375507 | A1 | 12/2015 | Ikushima |
| 2016/0052312 | A1 | 2/2016 | Pitz et al. |
| 2016/0074822 | A1 | 3/2016 | Sang-Yun |
| 2016/0288552 | A1 | 10/2016 | Ikushima |
| 2016/0306364 | A1 | 10/2016 | Ikushima et al. |
| 2017/0087837 | A1 | 3/2017 | Stefani et al. |
| 2017/0106393 | A1 | 4/2017 | Hamspon et al. |
| 2017/0136481 | A1 | 5/2017 | Fritz et al. |
| 2017/0252765 | A1 | 9/2017 | Medard |
| 2017/0267002 | A1 | 9/2017 | Pitz et al. |
| 2017/0299088 | A1 | 10/2017 | Rau |
| 2017/0361346 | A1 | 12/2017 | Lahidjanian et al. |
| 2018/0022105 | A1 | 1/2018 | Nakamura et al. |
| 2018/0056670 | A1 | 3/2018 | Kerr |
| 2018/0093491 | A1 | 4/2018 | Murayama et al. |
| 2018/0178505 | A1 | 6/2018 | Stefani et al. |
| 2018/0222186 | A1 | 8/2018 | Stefani et al. |
| 2018/0250955 | A1 | 9/2018 | Herre |
| 2019/0091712 | A1 | 3/2019 | Cyrille et al. |

FOREIGN PATENT DOCUMENTS

| | | | |
|---|---|---|---|
| CN | 1512919 | A | 7/2004 |
| CN | 1176815 | C | 11/2004 |
| CN | 1761530 | A | 4/2006 |
| CN | 101309755 | A | 11/2008 |
| CN | 101657264 | A | 2/2010 |
| CN | 102177002 | A | 9/2011 |
| CN | 102198434 | A | 9/2011 |
| CN | 102971080 | A | 3/2013 |
| CN | 103153483 | A | 6/2013 |
| CN | 104613205 | A | 5/2015 |
| CN | 104994966 | A | 10/2015 |
| CN | 105358259 | A | 2/2016 |
| DE | 1284250 | A | 11/1968 |
| DE | 7710895 | U1 | 9/1977 |
| DE | 3045401 | A1 | 7/1982 |
| DE | 3221327 | A1 | 9/1983 |
| DE | 3225554 | A1 | 1/1984 |
| DE | 3634747 | A1 | 8/1987 |
| DE | 3804092 | A1 | 9/1988 |
| DE | 4115111 | A1 | 11/1991 |
| DE | 4138491 | A1 | 5/1993 |
| DE | 9405600 | U1 | 6/1994 |
| DE | 68924202 | T2 | 2/1996 |
| DE | 19606716 | C1 | 8/1997 |
| DE | 19630290 | A1 | 1/1998 |
| DE | 19731829 | A1 | 1/1999 |
| DE | 19743804 | A1 | 4/1999 |
| DE | 9422327 | U1 | 3/2000 |
| DE | 19852079 | A1 | 5/2000 |
| DE | 19936790 | A1 | 2/2001 |
| DE | 20017629 | U1 | 3/2001 |
| DE | 10048749 | A1 | 4/2002 |
| DE | 69429354 | T2 | 5/2002 |
| DE | 69622407 | T2 | 3/2003 |
| DE | 10307719 | A1 | 9/2003 |
| DE | 60001898 | T2 | 2/2004 |
| DE | 102004021223 | A1 | 12/2004 |
| DE | 10331206 | A1 | 1/2005 |
| DE | 102004034270 | A1 | 2/2006 |
| DE | 102004044655 | A1 | 3/2006 |
| DE | 102004049471 | A1 | 4/2006 |
| DE | 60212523 | T2 | 2/2007 |
| DE | 69836128 | T2 | 8/2007 |
| DE | 60125369 | T2 | 10/2007 |
| DE | 102006021623 | A1 | 11/2007 |
| DE | 102006056051 | A1 | 5/2008 |
| DE | 102007018877 | A1 | 10/2008 |
| DE | 102007037663 | A1 | 2/2009 |
| DE | 10 2008 018 881 | A1 | 9/2009 |
| DE | 102008053178 | A1 | 5/2010 |
| DE | 102009029946 | A1 | 12/2010 |
| DE | 102009038462 | A1 | 3/2011 |
| DE | 102010004496 | A1 | 7/2011 |
| DE | 102010019612 | A1 | 11/2011 |
| DE | 102012006371 | A1 | 7/2012 |
| DE | 102012005087 | A1 | 10/2012 |
| DE | 102012005650 | A1 | 9/2013 |
| DE | 102012212469 | A | 1/2014 |
| DE | 102012109123 | A1 | 3/2014 |
| DE | 202013101134 | U1 | 6/2014 |
| DE | 102013002412 | A1 | 8/2014 |
| DE | 102013011107 | A1 | 8/2014 |
| DE | 102013205171 | A1 | 9/2014 |
| DE | 102014006991 | A1 | 12/2014 |
| DE | 102014007523 | A1 | 11/2015 |
| DE | 102014008183 | A1 | 12/2015 |
| DE | 102014012705 | A1 | 3/2016 |
| DE | 102014013158 | A1 | 3/2016 |
| EP | 0138322 | A1 | 4/1985 |
| EP | 0297309 | A2 | 1/1989 |
| EP | 0665106 | A2 | 8/1995 |
| EP | 1120258 | A2 | 8/2001 |
| EP | 1764226 | A1 | 3/2007 |
| EP | 1852733 | A1 | 11/2007 |
| EP | 1884365 | A1 | 2/2008 |
| EP | 1946846 | A2 | 7/2008 |
| EP | 2002898 | A1 | 12/2008 |
| EP | 2133154 | A2 | 12/2009 |
| EP | 2151282A1 | A1 | 2/2010 |
| EP | 2196267 | A2 | 6/2010 |
| EP | 2380744 | A2 | 10/2011 |
| EP | 2433716 | A1 | 3/2012 |
| EP | 2468512 | A1 | 6/2012 |
| EP | 2641661 | A1 | 9/2013 |
| EP | 2644392 | A2 | 10/2013 |
| EP | 2777938 | A1 | 9/2014 |
| EP | 2799150 | A1 | 11/2014 |
| EP | 2842753 | A1 | 3/2015 |
| EP | 3002128 | A2 | 4/2016 |
| EP | 3156138 | A1 | 4/2017 |
| EP | 3213823 | A1 | 9/2017 |
| EP | 3257590 | A1 | 12/2017 |
| EP | 3272669 | A1 | 1/2018 |
| EP | 3068626 | B1 | 10/2019 |
| FR | 3010918 | A1 | 3/2015 |
| GB | 2200433 | A | 8/1988 |
| GB | 2367771 | A | 4/2002 |
| GB | 2507069 | A | 4/2014 |
| GN | 1438942 | A | 8/2003 |
| GN | 1668386 | A | 9/2005 |
| GN | 101264698 | A | 9/2008 |
| GN | 101784348 | A | 7/2010 |
| GN | 103909743 | A | 7/2014 |
| GN | 106414081 | A | 2/2017 |
| JP | S5722070 | A | 2/1982 |
| JP | 562116442 | A | 5/1987 |
| JP | H04-106669 | U | 9/1992 |
| JP | H0798171 | B2 | 10/1995 |
| JP | H09192583 | A | 7/1997 |
| JP | 2000158670 | A | 6/2000 |
| JP | 2000317354 | A | 11/2000 |
| JP | 2001129456 | A | 5/2001 |
| JP | 2001157863 | A | 6/2001 |
| JP | 2001239652 | A | 9/2001 |
| JP | 2001300404 | A | 10/2001 |
| JP | 2002361863 | A | 12/2002 |
| JP | 2003506210 | A | 2/2003 |
| JP | 2003136030 | A | 5/2003 |
| JP | 2004142382 | A | 5/2004 |
| JP | 2005526234 | A | 9/2005 |
| JP | 2007021760 | A | 2/2007 |
| JP | 2007152666 | A | 6/2007 |
| JP | 2007520340 | A | 7/2007 |
| JP | 2007245633 | A | 9/2007 |
| JP | 2007289848 | A | 11/2007 |
| JP | 2010531213 | A | 9/2010 |
| JP | 2010531729 | A | 9/2010 |

(56) References Cited

FOREIGN PATENT DOCUMENTS

| | | | |
|---|---|---|---|
| JP | 2010241003 | A | 10/2010 |
| JP | 2011206958 | A | 10/2011 |
| JP | 2012506305 | A | 3/2012 |
| JP | 2012135925 | A | 7/2012 |
| JP | 2012206116 | A | 10/2012 |
| JP | 2012228643 | A | 11/2012 |
| JP | 2012228660 | | 11/2012 |
| JP | 2013067179 | A | 4/2013 |
| JP | 2013530816 | A | 8/2013 |
| JP | 2013530816 | B2 | 8/2013 |
| JP | 2013188706 | A | 9/2013 |
| JP | 2014019140 | A | 2/2014 |
| JP | 2014050832 | A | 3/2014 |
| JP | 2014111307 | A | 6/2014 |
| JP | 2015-009222 | A | 1/2015 |
| JP | 2015096322 | A | 5/2015 |
| JP | 2015520011 | A | 7/2015 |
| JP | 2015193129 | A | 11/2015 |
| JP | 2016507372 | A | 3/2016 |
| JP | 2016526910 | A | 9/2016 |
| JP | 2016175077 | A | 10/2016 |
| JP | 2016175662 | A | 10/2016 |
| JP | 2018012065 | A | 1/2018 |
| JP | 2020513311 | A | 5/2020 |
| JP | 2020513314 | A | 5/2020 |
| WO | 8601775 | A1 | 3/1986 |
| WO | 9856585 | A1 | 12/1998 |
| WO | 02098576 | A1 | 12/2002 |
| WO | 03021519 | A1 | 3/2003 |
| WO | 2003062129 | A2 | 7/2003 |
| WO | 2004048112 | A1 | 6/2004 |
| WO | 2004085738 | A2 | 10/2004 |
| WO | 2005016556 | A1 | 2/2005 |
| WO | 2005075170 | A1 | 8/2005 |
| WO | 2006022217 | A1 | 3/2006 |
| WO | 2007121905 | A1 | 11/2007 |
| WO | 2009019036 | A1 | 2/2009 |
| WO | 2010046064 | A1 | 4/2010 |
| WO | 2010146473 | A1 | 12/2010 |
| WO | 2011044491 | A1 | 4/2011 |
| WO | 2011128439 | A1 | 10/2011 |
| WO | 2011138048 | A1 | 11/2011 |
| WO | 2013121565 | A1 | 8/2013 |
| WO | 2015071270 | A1 | 5/2015 |
| WO | 2015096322 | A1 | 7/2015 |
| WO | 2015186014 | A1 | 12/2015 |
| WO | 2016-087016 | A1 | 6/2016 |
| WO | 2016142510 | A1 | 9/2016 |
| WO | 2016145000 | A1 | 9/2016 |
| WO | 2017006245 | A1 | 1/2017 |
| WO | 2017006246 | A1 | 1/2017 |
| WO | 2018102846 | | 6/2018 |

OTHER PUBLICATIONS

European Search Report for EP20170638.9 dated Sep. 14, 2020 (4 pages—English translation not available).
European Search Report for EP20170021.8 dated Sep. 8, 2020 (11 pages—English translation not available).
European Search Report for EP20170025.9 dated Sep. 9, 2020 (4 pages—English translation not available).
European Search Report for EP20170016.8 dated Sep. 7, 2020 (4 pages—English translation not available).
EPO Examination Report for Application No. 201702818.1 dated Dec. 18, 2020 (with English machine translation; 6 pages).
JPO Submission for JP2019-531096; submitted Dec. 21, 2020 (32 pages; with English translation).
JPO Submission for JP2019-531957; submitted Dec. 21, 2020 (21 pages; with English translation).
Ghasem, G et al.; "Chapter 2 Background on Sprays and Their Production", Industrial Sprays and Atomization Design, Analysis and Applications, Jan. 1, 2002, Springer, London, pp. 7-33, XP009195118, ISBN 978-1-4471-3816-7.
International Search Report and Written Opinion for PCT/EP2017/081141 dated Feb. 26, 2018 (17 pages; with English translation).
International Search Report and Written Opinion for PCT/EP2017/081114 dated May 15, 2018 (33 pages; with English translation).
Anonymous: "Roboterkalibrierung—Wikipedia", Nov. 7, 2016, XP055471615, Gefunden im Internet: URL: https://de.wikipedia.org/w/index.php?title=Roboterkalibrierung&oldid=159460756 [gefunden am Apr. 30, 2018] das ganze dockument (8 pages; with English translation).
Beyer, Lukas: "Genauigkeitssteigerung von Industrierobotern", Forschungsberichte Aus Dem Laboratorium Fertigungstechnik/Helmut-Schmidt-Universitat, Universitat Der Bundeswehr Hamburg, Dec. 31, 2005, Seiten 1-4, XP009505118; ISSN: 1860-2886; ISBN: 978-3-8322-3681-6 (13 pages; with English machine translation).
International Search Report and Written Opinion for PCT/EP2017/081108 dated Feb. 28, 2018 (with English translation; 18 pages).
International Search Report and Written Opinion for PCT/EP2017/081099 dated Feb. 26, 2018 (21 pages; with English translation).
International Search Report and Written Opinion for PCT/EP2017/081102 dated Mar. 14, 2018 (16 pages; with English translation).
International Search Report and Written Opinion for PCT/EP2017/081105 dated Feb. 26, 2018 (19 pages; with English translation).
International Search Report and Written Opinion for PCT/EP2017/081152 dated May 15, 2018 (25 pages; with English translation).
International Search Report and Written Opinion for PCT/EP2017/081098 dated May 14, 2018 (26 pages; with English translation).
International Search Report and Written Opinion for PCT/EP2017/081101 dated Feb. 28, 2018 (14 pages; with English translation).
International Search Report and Written Opinion for PCT/EP2017/081121 dated Feb. 26, 2018 (20 pages; with English translation).
International Search Report and Written Opinion for PCT/EP2017/081117 dated Mar. 12, 2018 (27 pages; with English translation).
International Search Report and Written Opinion for PCT/EP2017/081123 dated Feb. 26, 2018 (20 pages; with English translation).
Non-Final Office Action for U.S. Appl. No. 16/468,691 dated Jan. 7, 2021 (79 pages).
China National Intellectual Property Administration Office Action and Search Report for CN Application No. 201780077018.3 dated Aug. 27, 2020 (11 pages; Search Report in English).
Chinese Office Action for Application No. CN20178007017 9 dated Aug. 31, 2020 (8 pages; with English translation).
Non Final Office Action for U.S. Appl. No. 16/468,697 dated Oct. 22, 2020 (78 pages).
Non Final Office Action for U.S. Appl. No. 16/468,696 dated Nov. 2, 2020 (58 pages).
Non Final Office Action for U.S. Appl. No. 16/468,689 dated Oct. 15, 2020 (77 pages).
Chinese Office Action for CN201780077476.7 dated Sep. 23, 2020 (12 pages; English translation not available).
Non Final Office Action for U.S. Appl. No. 16/468,700 dated Dec. 1, 2020 (73 pages).
Fianl Office Action dated May 13, 2021 for U.S. Appl. No. 16/468,691 (70 pages).
Non-Final Office Action dated Feb. 5, 2021 for U.S. Appl. No. 16/468,701 (80 pages).
Final Office Action dated Mar. 19, 2021 for U.S. Appl. No. 16/468,696 (45 pages).
Notice of Allowance mailed in U.S. Appl. No. 16/468,689 dated Jun. 2, 2021 (38 pages).
UPO Notification of Reasons for Rejection for Application No. JP2019-532030 dated May 18, 2021 (6 pages; with English translation).
CIPO Office Action for Application No. CN201780077474.8 dated Apr. 26, 2021 (17 pages; with English translation).
EPO Official Notification of Opposition for Application No. 17821803.8 dated Feb. 10, 2021 (64 pages; with English machine translation).
Non-Final Office Action dated Apr. 28, 2021 for U.S. Appl. No. 16/468,693 (109 pages).
Final Office Action dated Apr. 19, 2021 for U.S. Appl. No. 16/468,700 (62 pages).
Final Office Action dated Jun. 11, 2021 for U.S. Appl. No. 16/468,701 (53 pages).

(56) References Cited

OTHER PUBLICATIONS

Chinese Office Action dated Jun. 2, 2021 for Application No. CN201780077017 9 (17 pages; with English machine translation).
Japanese Notification of Reasons for Rejection dated Jun. 1, 2021 for Application No. JP2019-531944 (14 pages with English machine translation).
Japanese Notification of Reasons for Rejection dated Jun. 8, 2021 for Application No. JP2019-531957 (13 pages with English machine translation).
Supplemental Notice of Allowability dated Jul. 8, 2021 for U.S. Appl. No. 16/468,696 (11 pages).
Liptak, Bela. (2006). Instrument Engineers' Handbook (4th Edition)—Process Control and Optimization, vol. 2 -2.1.3.5 Process Time Constant, (pp. 99-102). Taylor & Francis. Retrieved from https://app.knovel.eom/hotlink/pdf/id:kt00CC7HL1/instrument-engineers/process-time-constant (Year: 2006).
Japenese Patent Office Notice of Reasons of Refusal for Application No. JP 2019-531967 dated Jun. 8, 2021 (8 pages; with English machine translation).
Notification of Reasons for Refusal for Application No. JP2019-532012 dated Jun. 22, 2021 (6 pages; with English machine translation).
Notification of Reasons for Refusal for Application No. JP2019-527330 dated Jun. 22, 2021 (10 pages; with English machine translation).
JPO Office Action for Application No. JP2019-531097 dated Jun. 29, 2021 (10 pages; with English machine translation).
JPO Office Action for Application No. 2019-531096 dated Jul. 6, 2021 (9 pages; with English machine translation).
JPO Office Action for Application No. 2019-531098 dated Jul. 6, 2021 (5 pages; English translation only).
JPO Office Action for Application No. 2019-531459 dated Jul. 6, 2021 (8 pages; with English machine translation).
JPO Office Action dated Jul. 3, 2021 for Application No. JP2019-532024 (12 pages; with English machine translation).
Non-Final Office Action dated Aug. 27, 2021 for USPA No. U.S. Appl. No. 16/468,695 (149 pages).

* cited by examiner

COATING DEVICE AND ASSOCIATED OPERATING METHOD

CROSS-REFERENCE TO RELATED APPLICATIONS

This application is a national stage of, and claims priority to, Patent Cooperation Treaty Application No. PCT/EP2017/081099, filed on Dec. 1, 2017, which application claims priority to German Application No. DE 10 2016 014 951.5, filed on Dec. 14, 2016, which applications are hereby incorporated herein by reference in their entireties.

BACKGROUND

The disclosure concerns a coating installation for coating components with a coating agent, in particular for painting vehicle body components. Furthermore, the disclosure concerns an associated operating method for such a coating installation.

For the serial painting of car body components, rotary atomizers are usually used as application devices, which have the disadvantage of a limited application efficiency, i.e. only a part of the applied paint is deposited on the components to be coated, while the rest of the applied paint has to be disposed of as so-called overspray.

A newer development line, on the other hand, provides for so-called print heads as application equipment, as known for example from DE 10 2013 002 412 A1, U.S. Pat. No. 9,108,424 B2 and DE 10 2010 019 612 A1. In contrast to the known rotary atomizers, such print heads do not emit a spray mist of the paint to be applied, but a paint jet that is spatially narrowly confined and almost completely deposited on the component to be painted, so that almost no overspray occurs.

However, such printheads usually have nozzles with a very small nozzle diameter of less than 500 μm or even less than 100 μm. However, such small nozzles can easily clog or even completely clog during operation. For example, individual paint particles can initially deposit in the nozzle, which initially only adversely affect the otherwise laminar flow of coating agent, for example by causing turbulence. Further deposition of paint particles can lead to complete clogging of the nozzle.

With regard to the general technical background of the disclosure, reference should also be made to DE-AS 1 284 250, DE 10 2004 021 223 A1, GB 2 507 069 A, DE 103 31 206 A1, WO 2016/145000 A1, EP 0 297 309 A2, DE 689 24 202 T2, DE 103 07 719 A1 and DE 30 45 401 A1. However, some of these publications do not concern nozzle applicators, but spray applicators which emit a spray jet. In some cases, however, the coating installation known from these publications also suffers from the problems described above.

DETAILED DESCRIPTION

Figure 1:
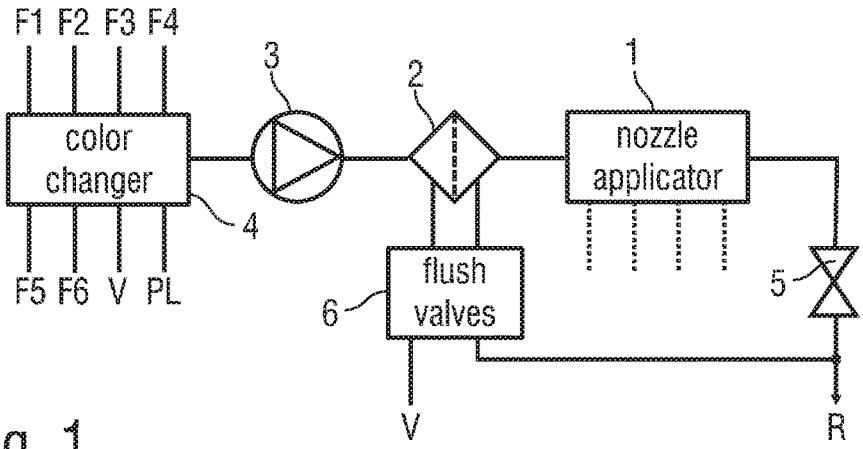
FIG. 1 a schematic representation of a coating installation according to disclosure with a nozzle applicator and a filter to prevent clogging of the nozzles of the nozzle applicator, FIG. 2 a variation of FIG. 1 with two optional filters, FIG. 3 a modification of FIG. 3 with a color changer and numerous filters in the feed lines of the color changer, FIG. 4A a schematic representation of a coating installation according to the disclosure having a camera-based means for detecting clogging of the nozzles of the nozzle applicator, FIG. 4B a variation of FIG. 4A, FIG. 5 a modification of FIG. 4A or 4B with several light barriers for measuring the coating agent jets, FIG. 6 a modification of FIG. 5 with a capacitive sensor that measures all coating agent jets together, FIG. 7 a variation of FIG. 6 with a capacitive sensor that measures the flow of coating agent in a channel carrying coating agent.

The disclosure is based on the task of finding a solution to the problem of complete or partial clogging of the nozzles in a nozzle applicator (e.g. print head).

The coating installation according to the disclosure is used for coating components with a coating agent, in particular for painting vehicle body components.

The components to be coated do not necessarily have to be motor vehicle body components. Rather, the coating installation according to the disclosure can also be used for coating other types of components.

It should also be mentioned that the coating agent is preferably a paint, such as a base coat, a clear coat, a water-based paint or a solvent-based paint. Within the scope of the disclosure, however, the coating installation may also be designed for the application of other coating agents, such as adhesives, insulating materials, sealants, primers, etc.

The coating installation according to the disclosure initially has a nozzle applicator in accordance with the state of the art, such as a print head as mentioned at the beginning and described in DE 10 2013 002 412 A1, U.S. Pat. No. 9,108,424 B2 and DE 10 2010 019 612 A1, so that a detailed description of the structure and function of such print heads can be dispensed with.

The coating installation features an additional device to prevent and/or detect nozzle clogging. One aspect of the disclosure is therefore to prevent clogging of the nozzle. Another aspect, on the other hand, is based on the fact that clogging of the nozzle with a resulting deterioration of the coating quality is detected so that countermeasures can be taken if necessary.

In the disclosure, clogging of the nozzle can be prevented, for example, by a filter arranged upstream of the nozzle which filters the coating agent so that, for example, solid coating agent particles are filtered out as these could lead to clogging of the nozzle.

It should be noted that the filter preferably has a certain filter mesh size, which is preferably adapted to the nozzle size of the nozzle opening of the nozzle. For example, the ratio of the filter mesh size to the nozzle size can be in the range of 0.01-5, whereby any intermediate intervals are possible. Preferred values for the ratio of the filter mesh size to the nozzle size are for example 0.075, 0.1, 0.15, 0.66, 1.0 and 2.0.

In an example of the disclosure, this filter can be rinsed with a flushing agent in order to be able to rinse out filtered coating agent residues from the filter again. For this purpose, the filter is flushed with a flushing agent. The flushing agent can be passed through the filter either against the normal flow direction or in the normal flow direction. In addition, it is also possible for the flushing agent to be passed through the filter alternately against the normal flow direction and in the normal flow direction during a rinsing process in order to achieve the best possible rinsing effect. The coating installation therefore preferably has a flushing agent connection to supply the flushing agent. In addition, the coating installation preferably has a recirculation connection in order to recirculate a mixture of coating agent residues and flushing agent. The coating installation may also have a flushing valve arrangement connected to the flushing agent connection and the return connection on the one hand and to two corresponding filter connections on the other hand. The flushing valve arrangement preferably enables a bidirectional flushing of the filter with the flushing agent, i.e. either against the normal flow direction or in the normal flow direction.

The disclosure also makes it possible for the filter to be a double filter with two individual filters arranged parallel to each other. The coating agent can then be directed either into one single filter or into the other single filter by means of a selection valve arrangement. In addition, the selection valve arrangement directs the flushing agent either into one individual filter or into the other individual filter. This allows the coating agent to flow through one filter while the other filter is flushed. Such an operation can also be referred to as A/B operation, as it is known in the field of painting technology for so-called A/B valves. In this way, the necessary rinsing processes do not lead to an interruption of the normal coating operation, as the other individual filter is still available for filtering the coating agent during the rinsing of one individual filter.

It should also be mentioned that the coating installation according to the disclosure may have a metering pump which conveys the coating agent to the nozzle applicator. The filter can be arranged either between the metering pump and the nozzle applicator or upstream of the metering pump.

In addition, the coating installation according to the disclosure in an example includes a colour changer which selects a desired coating agent from several coating agent supply lines and forwards it to the nozzle applicator. Here it is possible that a filter is arranged in each of the individual coating agent supply lines upstream of the colour changer in order to filter the supplied coating agent. The individual filters at the inputs of the colour changer can then be individually adapted to the respective coating agent.

It should also be mentioned that the filter may have internal contours that are free of undercuts. In addition, the internal surfaces of the filter in the flowed through areas preferably have a very low roughness number Rz<10, Rz<8, Rz<7, Rz<6.3, Rz<5 or even Rz<4.

It has already been briefly mentioned above that a second aspect of the disclosure is not aimed at preventing the clogging of the nozzle, but at detecting the clogging of a nozzle. This aspect of the disclosure therefore prefers a sensor arrangement in order to be able to distinguish a fault-free jet delivery from a faulty jet delivery.

In an example of the disclosure, the sensor arrangement has an image sensor, such as a camera. The image sensor captures an image of at least one coating agent jet or several coating agent jets emitted by the nozzle applicator. Here, the viewing axis of the image sensor (e.g. camera) is preferably orthogonal to the coating agent jets and parallel to the plane of the coating agent jets, i.e. the image sensor observes the coating agent jets from the front. It is also possible, however, that the viewing axis is aligned transversely to the plane of the coating agent jets, i.e. the image sensor looks at the coating agent jets from the side. In a special version, both views can be acquired one after the other or by means of two sensors. In addition, the sensor arrangement in this example may have an image evaluation unit that evaluates the image of the coating agent jets captured by the image sensor and detects errors therein, such as a missing coating agent jet due to the clogging of a nozzle.

The image acquisition can be improved by an illumination device, which is arranged in the line of sight of the image sensor on the opposite side of the coating agent jets.

The image evaluation unit can preferably detect and distinguish the following errors:

- an oblique coating agent jet which exits obliquely to the nozzle axis due to partial clogging of a nozzle,
- an unstable coating agent jet that prematurely disintegrates into coating agent droplets,
- a coating agent jet with an insufficient amount of coating agent,
- a disturbed coating agent jet, and/or a missing coating agent jet due to complete clogging of the nozzle.

In another example of the disclosure, the sensor arrangement has a capacitive sensor which measures several coating agent jets together.

Alternatively, however, it is also possible for the capacitive sensor to measure only one single coating agent jet capacitively, whereby a capacitive sensor is then preferably provided for each nozzle.

In another example of the disclosure, the sensor arrangement has a light barrier, whereby the coating agent jet from the nozzle passes through the light barrier and is measured by the light barrier. Each nozzle is preferably assigned a light barrier, which is passed by the respective coating agent jet.

In another example of the disclosure, the coating agent flows through a coating agent channel and is measured in the coating agent channel by a capacitive sensor or by a resistive sensor (resistance sensor) in order to infer errors (e.g. insufficient flow rate).

In general it should be mentioned that the print head preferably emits a narrowly limited jet of coating agent in contrast to a spray mist, as is the case with conventional atomizers (e.g. rotary atomizers).

The print head, for example, can emit a droplet jet as opposed to a continuous jet of coating agent in the longitudinal direction of the jet.

Alternatively, it is also possible for the print head to emit a coating agent jet being continuous in the longitudinal direction of the jet, as opposed to a droplet jet.

Preferably, the print head has a very high application efficiency of at least 80%, 90%, 95% or even 99%, so that essentially the entire applied coating is completely deposited on the component, without the formation of annoying overspray.

In addition, it should be noted that the print head preferably has a high areal coating performance which is preferably so large that the print head is suitable for painting automotive body parts. The areal coating performance of the nozzle applicator is therefore preferably greater than 0.5 $m^2$/min, 1 $m^2$/min or even 3 $m^2$/min.

The nozzle applicator is preferably moved by means of a manipulator, which is preferably a multi-axis painting robot with serial robot kinematics and at least six movable robot axes.

The control of the coating agent delivery in the nozzle applicator is preferably carried out by control valves with a controllable actuator, such as a magnetic actuator or a piezo actuator.

It should also be mentioned that the disclosure does not only claim protection for the nozzle applicator described above with the device for preventing or detecting the clogging of a nozzle. Rather, the disclosure also claims protection for a complete painting facility, for example for painting car body components.

In addition, the disclosure also includes a corresponding operating method, whereby the procedural steps of the operating method already result from the above description and therefore do not have to be described separately.

In a modification of the operating method according to the disclosure, the nozzle applicator with opened nozzles is moved over a test surface (e.g. fleece, glass plate), whereby the nozzle applicator applies coating agent jets to the test surface and thereby produces a spray pattern on the test surface. The spray pattern can then be used to determine whether the nozzles are partially or completely clogged. The operating method according to the disclosure therefore provides in this variant that the spray pattern is evaluated on the test surface, for example with a camera and an image evaluation unit.

After a deviation has been detected, the following actions, for example, can be triggered:

Error message,

Back-flushing of applicator or nozzle plate, back-flushing (i.e. from outside to inside), Nozzle cleaning (from outside and from inside to outside), Replacement of applicator (completely).

With regard to the frequency of the above-mentioned test, the following possibilities exist, for example:

Execution of the test before each car body,

Execution of the test at predetermined intervals,

Execution of the test in predetermined time intervals in which no application is performed, Execution of the test after each colour change, Execution of the test at the start of production, Execution of the test at the beginning of each shift, Execution of the test at the end of each shift, Execution of the test at the end of production, Execution of the test after each fault, Referring to the Figures, FIG. 1 shows a simplified representation of a coating installation according to the disclosure with a nozzle applicator 1 as application device, whereby it can be, for example, a print head which emits spatially narrowly limited coating agent jets instead of a spray mist, as is the case with conventional atomizers (e.g. rotary atomizers).

The nozzle applicator 1 is supplied with the paint to be applied via a filter 2, a metering pump 3 and a color changer 4. For this purpose, the color changer 4 is connected on the input side to several coating agent supply lines F1-F6, via which different colored paints can be supplied.

In addition, the colour changer 4 is connected on the input side to a pulse air line PL and to a thinner line V, via which pulse air or flushing agent (thinner) can be supplied for flushing the nozzle applicator 1, the filter 2 and the metering pump 3.

In addition, the coating installation has a feedback valve 5 through which rinsed coating agent residues and flushing agent can be fed into a feedback R. The coating installation is equipped with a feedback valve 5 for the flushing of the coating agent and the flushing agent.

It should be mentioned here that the nozzle applicator 1 has numerous nozzles with a very small nozzle diameter, so that there is a risk of clogging of the nozzles of nozzle applicator 1. The filter 2 reduces this risk of clogging of the nozzles, as the filter 2 filters out coating components which can lead to clogging of the nozzles.

It should also be mentioned that the filter 2 can be flushed in order to flush out the filtered coating components from filter 2. For this purpose, the coating installation has a flushing valve arrangement 6, which is connected on the input side to the flushing agent supply line V and to the return line R. In addition, the flushing valve arrangement 6 is connected to an upstream and a downstream flushing connection of the filter 2. The flushing valve arrangement 6 can therefore optionally direct flushing agent through the filter 2 in the normal flow direction or against the normal flow direction in order to flush out coating agent residues from the filter 2.

Figure 2:
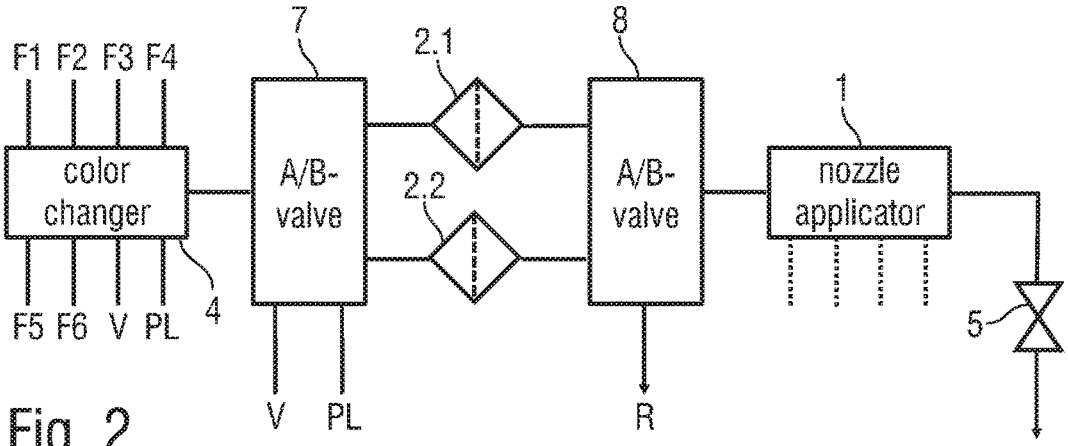

FIG. 2 shows a modification of FIG. 1 so that the above description is referred to in order to avoid repetition, using the same reference signs for corresponding details.

A feature of this example is that two single filters 2.1, 2.2 are provided which are connected in parallel. Upstream and downstream behind the two individual filters 2.1, 2.2 is a selection valve arrangement 7 and 8, respectively, which is connected to the two individual filters 2.1, 2.2.

The upstream selection valve arrangement 7 can supply coating agent and flushing agent either to the single filter 2.1 or to the single filter 2.2.

The downstream selection valve arrangement 8, on the other hand, can take up coating agent from one single filter 2.1 or 2.2 and supply it to nozzle applicator 1 and take up flushing agent and coating agent residues from the other single filter 2.2 or 2.1 and direct them to the recirculation R. The individual filters 2.1 and 2.2 can be connected to the individual filter 2.1 or 2.2.

In this way a so-called A/B operation is possible in which coating agents always flow through one of the two individual filters 2.1 or 2.2, while the other individual filter 2.2 or 2.1 is flushed with flushing agent.

Figure 3:
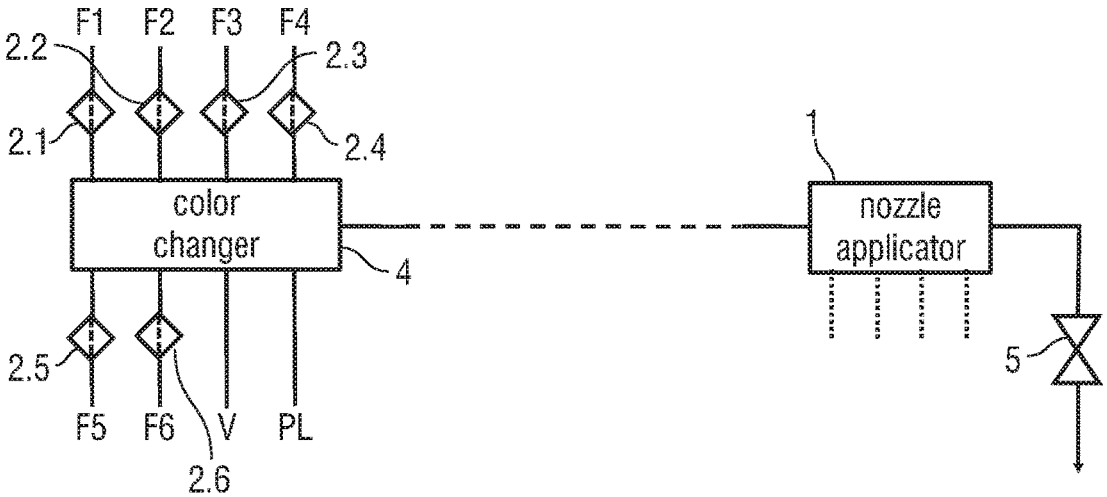

FIG. 3 shows a further modification, so that to avoid repetitions, reference is made to the above description, using the same reference signs for the relevant details.

A feature of this example is that a filter 2.1-2.6 is arranged in each of the coating agent supply lines F1-F6. This offers the possibility that the filter characteristics and filter properties of the individual filters 2.1-2.4 can be individually adapted to the properties of the respective coating agent.

Figure 4A:
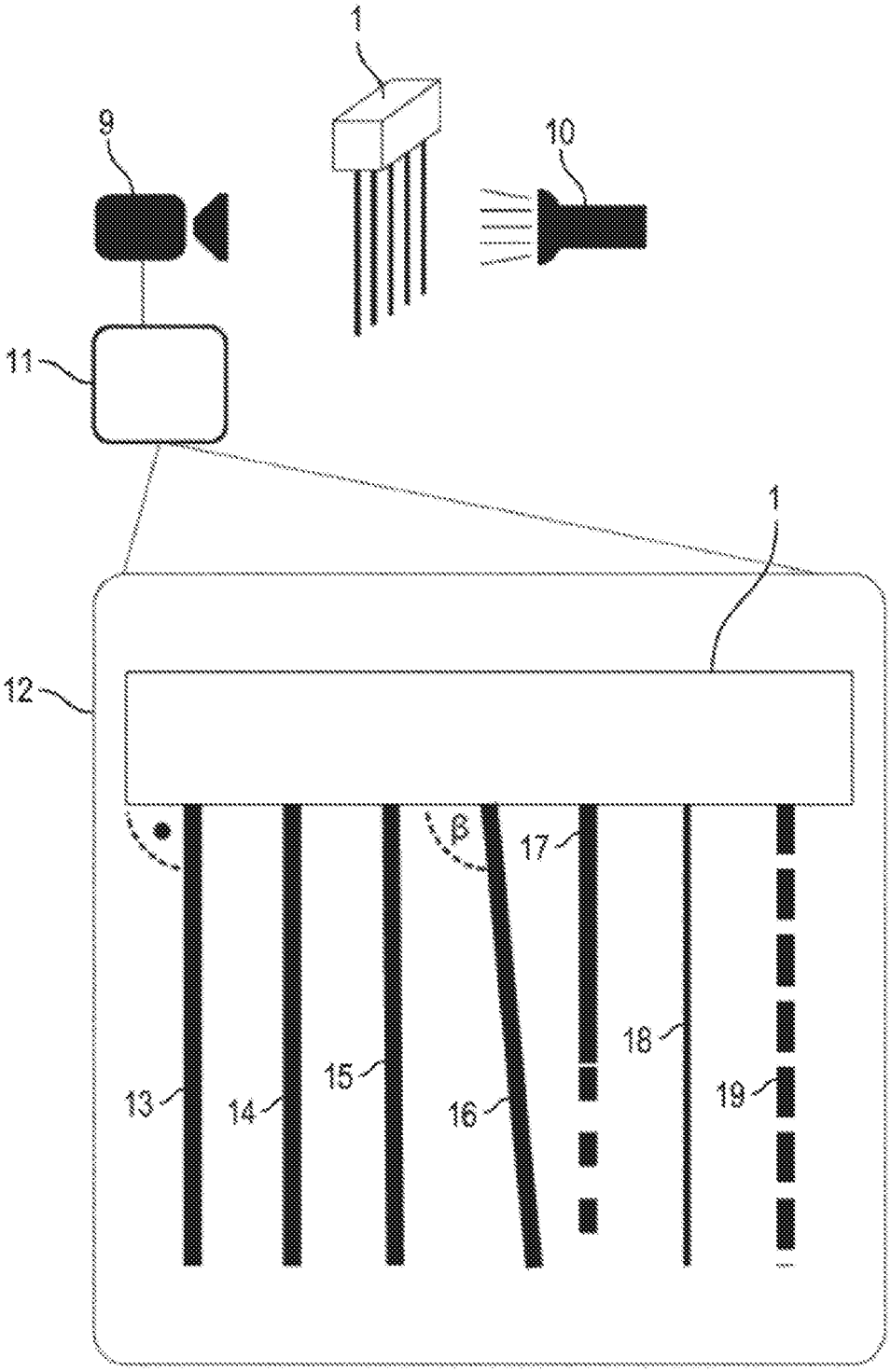

The following is a description of the example according to FIG. 4A, which is based on a second aspect of the disclosure in which the clogging of the nozzles of nozzle applicator 1 is detected so that countermeasures can then be taken if necessary.

For this purpose, the coating installation initially has a camera 9 which is arranged laterally next to the nozzle applicator 1 and is aligned with its viewing axis substantially at right angles to the plane of the coating agent jets. The camera 9 thus looks at the coating agent jets of nozzle applicator 1 from the side.

To improve image acquisition, an illumination device 10 is arranged on the opposite side of the coating agent jets.

The camera 9 is connected on the output side to an image evaluation unit 11, which evaluates the image of the coating agent jets captured by the camera 9 in order to detect errors.

For example, the lower part of the drawing shows an exemplary simplified representation of a captured image 12 with several coating agent jets 13-19.

The coating agent jets 13-15 are error-free.

The coating agent jet 16, on the other hand, emerges obliquely from nozzle applicator 1, which can be caused by partial clogging of the nozzle in question.

The coating agent jet 17, on the other hand, is unstable.

The coating agent jet 18, on the other hand, contains too little coating agent, which can be caused by partial clogging of the coating agent supply.

Finally, the coating agent jet 19 is disturbed.

The image evaluation unit 11 enables the detection and differentiation of the different types of faultless or faulty coating agent jets 13-19.

Figure 4B:
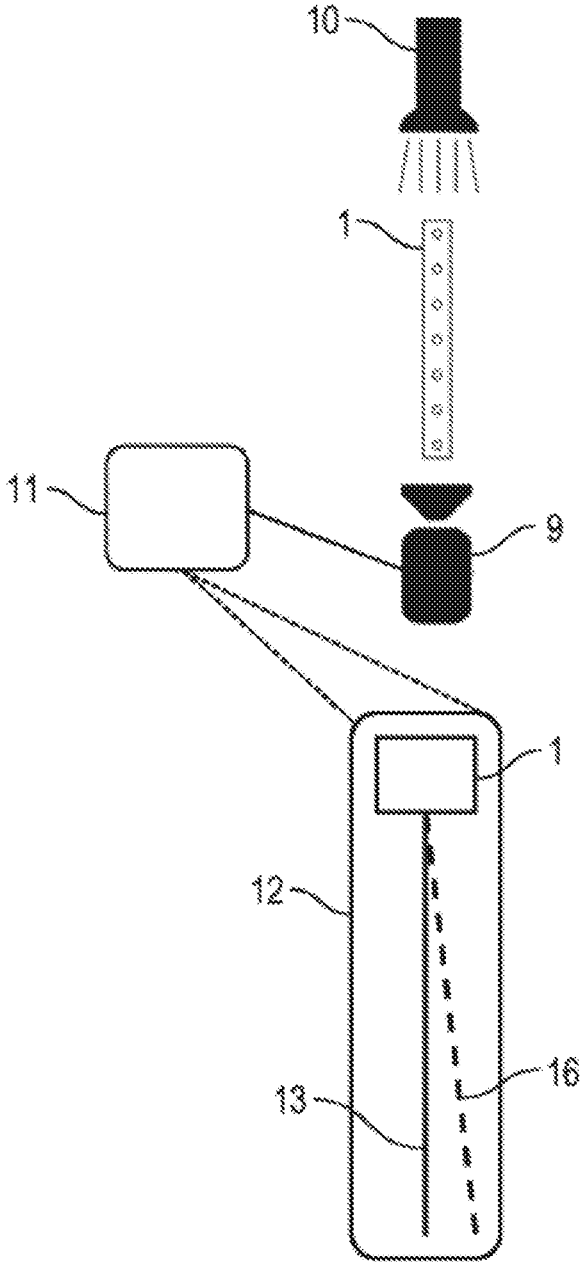

FIG. 4B shows a modification of FIG. 4A, so that to avoid repetitions, reference is made to the above description, using the same reference signs for corresponding details.

A feature of this example is that the line of sight of the camera 9 is perpendicular to the individual coating agent jets, but parallel to the plane of the coating agent jets.

Figure 5:
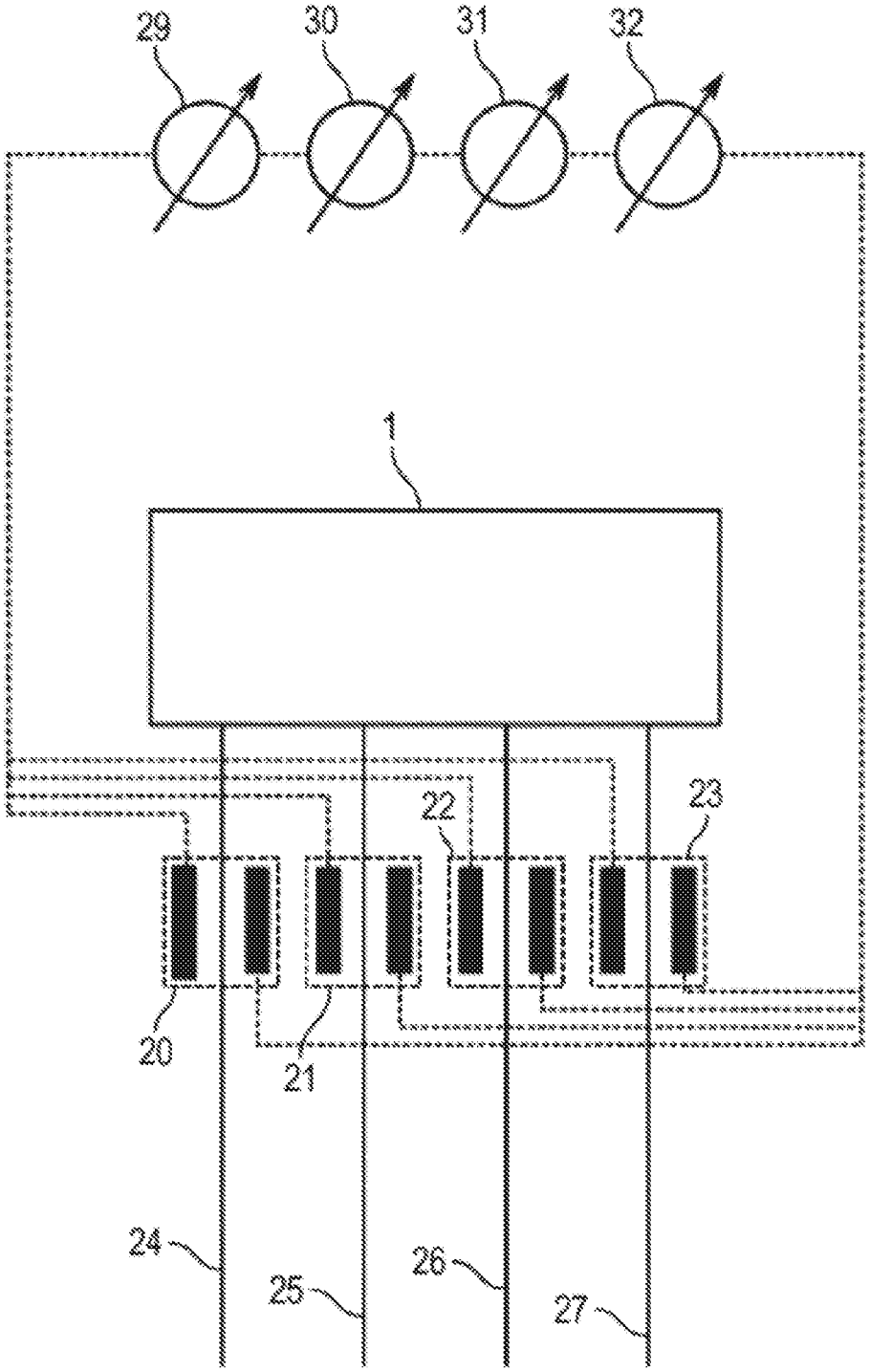

FIG. 5 shows a variation of the example in FIG. 4A and FIG. 4B, respectively, so that to avoid repetition, reference is made to the above description, using the same reference signs for appropriate details.

A feature of this example is that instead of the camera-based image acquisition system, several light barriers 20-23 are provided, each of which measures a coating agent jet 24-27 and is connected to an evaluation unit 28-31 to detect a missing coating agent jet.

Figure 6:
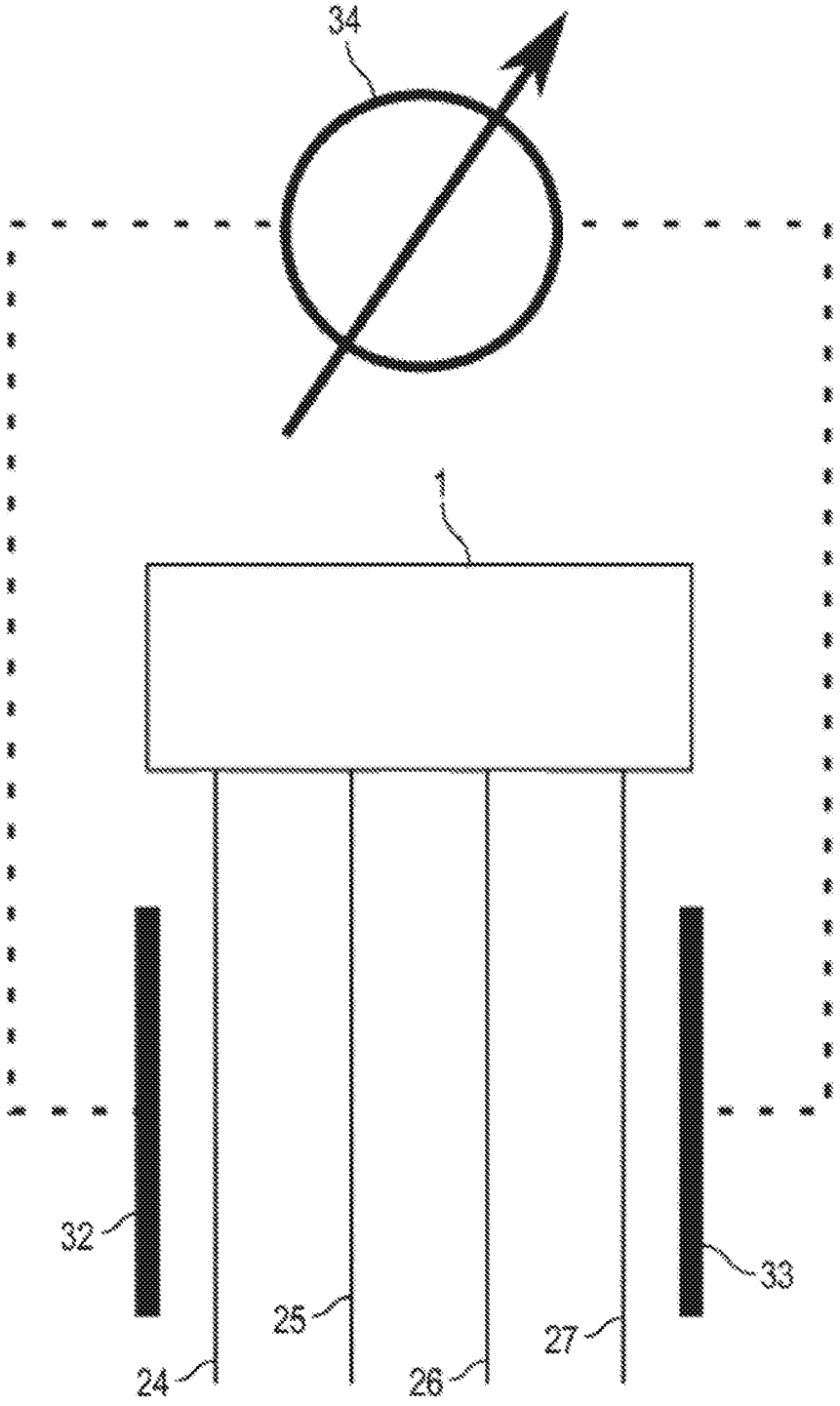

FIG. 6 shows a further variation so that, to avoid repetition, reference is made again to the above description, using the same reference signs for the relevant details.

A feature of this example is that instead of the light barriers 20-23 a capacitive sensor with two capacitor plates 32, 33 is used to measure the coating agent jets 24-27. The coating agent jets 24-27 thus run between the two capacitor plates 32, 33, so that the capacitive sensor measures all coating agent jets 24-27 together.

On the output side, the capacitive sensor 32, 33 is connected to an evaluation unit 34, which can detect faults.

Figure 7:
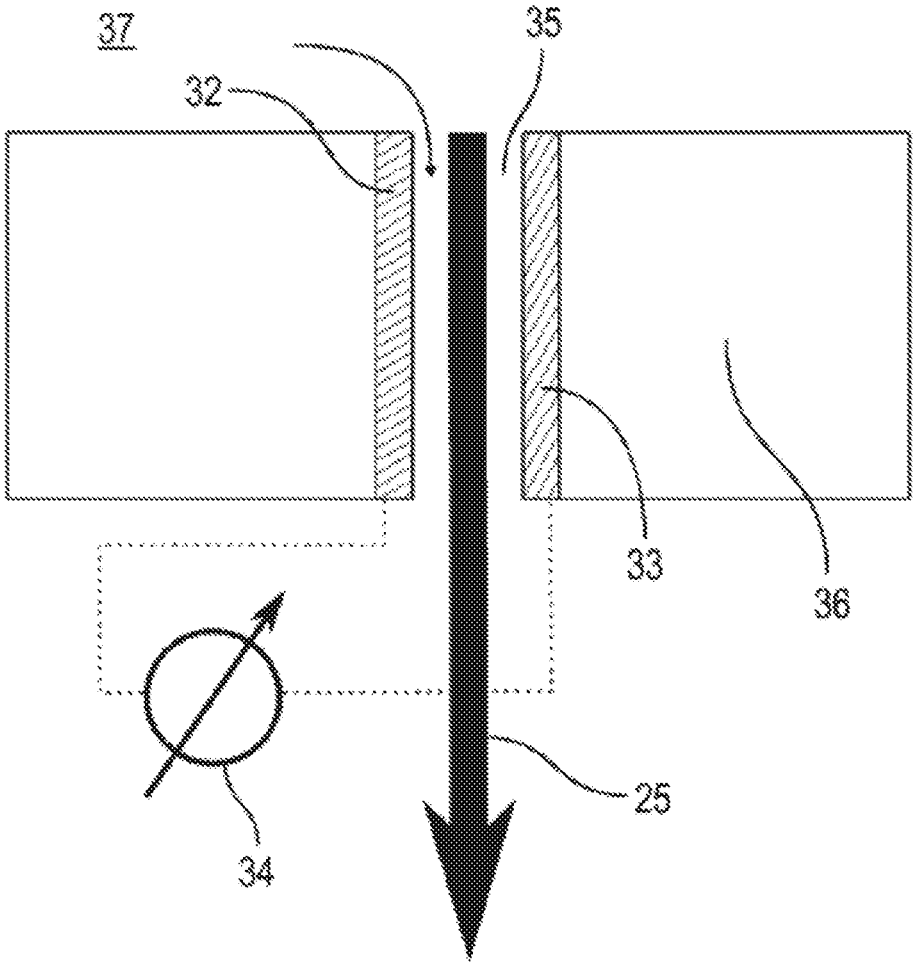

The example shown in FIG. 7 partially corresponds to the example shown in FIG. 6, so that reference is made to the above description to avoid repetitions, whereby the same reference signs are used for corresponding details.

A feature of this example is that the two capacitor plates 32, 33 of the capacitive sensor are arranged on the walls of a nozzle channel 35 which runs through a nozzle plate 36. The capacitive sensor with the two capacitor plates 32, 33 thus measures the coating agent flow through the nozzle channel 35 and can thus detect faults. The coating agent is fed through a paint feed 37 in the print head.

The disclosure is not limited to the preferred examples described above. Rather, the disclosure comprises a large number of variants and modifications which also make use of the inventive idea and therefore fall within the scope of protection. In particular, the disclosure also claims protection for the subject-matter and the features of the dependent claims independently of the claims referred to in each case. The disclosure thus comprises a large number of aspects of the disclosure which enjoy protection independently of each other.

The invention claimed is:

1. Coating installation for coating components with a coating agent, comprising:

a) a nozzle applicator having at least one nozzle for dispensing a coating agent jet of the coating agent onto the component to be coated, b) means for preventing nozzle clogging, the means for preventing including a filter upstream of the nozzle for filtering the coating agent, c) the nozzle has a nozzle orifice with a predetermined nozzle size, d) the filter has a specific filter mesh size, e) a ratio of the filter mesh size to the nozzle size is greater than 0.01, and f) a ratio of the filter mesh size to the nozzle size is less that 5.

2. Coating installation according to claim 1, wherein a) the coating agent flows through the filter in a normal flow direction during coating operation, b) the coating installation is adapted so that the filter can be flushed in the normal flow direction with a flushing agent, so that the flushing agent flows through the filter in the normal flow direction.

3. Coating installation according to claim 2, wherein a) the coating installation comprises a flushing agent port for supplying said flushing agent, and b) the coating installation has a return port for returning a mixture of coating agent and flushing agent to a return, and c) the coating installation comprises a flushing valve arrangement for selectively passing the flushing agent through the filter in the normal flow direction or against the normal flow direction.

4. Coating installation according to claim 1, wherein a) the coating agent flows through the filter in a normal flow direction during coating operation, b) the coating installation is adapted so that the filter can be flushed with a flushing agent against the normal flow direction, so that the flushing agent flows through the filter against the normal flow direction.

5. Coating installation in accordance with claim 1, wherein a) the filter is a double filter having two individual filters which are arranged parallel to one another, b) the coating agent is passed by a selection valve arrangement selectively into one individual filter or into the other individual filter, c) the flushing agent is passed by the selection valve arrangement selectively either into one individual filter or into the other individual filter, and d) one individual filter is flowed through by the flushing agent, while the other individual filter is flowed through by the coating agent.

6. Coating installation according to claim 1, wherein the filter is arranged between a metering pump and the nozzle applicator.

7. Coating installation according to claim 6, wherein the filter is arranged upstream of the metering pump.

8. Coating installation in accordance with claim 1, wherein a) the coating installation has a colour changer which selects a desired coating agent from a plurality of coating agent supply lines and forwards it to the nozzle applicator, b) a respective filter is arranged in each of the coating agent feed lines upstream of the colour changer.

9. Coating installation according to claim 8, wherein the respective filter at an input of each coating agent feed line of the colour changer are different and adapted to the respective coating agent.

10. Coating installation in accordance with claim 1, wherein the filter has internal contours which are free of undercuts.

11. Coating installation according to claim 1, wherein the filter has internal surfaces with a roughness number $Rz<10$.

12. Coating installation according to claim 1, further comprising a sensor arrangement for distinguishing a faultless jet delivery from a faulty jet delivery through the nozzle applicator.

13. Coating installation according to claim 1, wherein the nozzle has a nozzle diameter of less than 1 mm.

14. Coating installation for coating components with a coating agent, with a) a nozzle applicator having at least one nozzle for dispensing a coating agent jet of the coating agent onto the component to be coated, b) means for detecting nozzle clogging, the means for detecting nozzle clogging is a sensor arrangement for distinguishing a faultless jet delivery from a faulty jet delivery through the nozzle applicator, c) the sensor arrangement has an image sensor which detects an image of the coating agent jets, and d) a visual axis of the image sensor is aligned in the plane of the coating agent jets and transverse to the individual coating agent jets.

15. Coating installation according to claim 14, wherein the visual axis of the image sensor is aligned transverse to the plane of the coating agent jets and transverse to the individual coating agent jets.

16. Coating installation according to claim 14, wherein the sensor arrangement has an image evaluation unit which evaluates the image detected by the image sensor and recognizes errors therein.

17. Coating installation according to claim 14, wherein a lighting device is provided which is arranged in the visual axis of the image sensor on the opposite side of the coating agent jets.

18. Coating installation according to claim 14, wherein the image evaluation unit detects at least one of the following error cases by the image evaluation:

a) an oblique coating agent jet which emerges obliquely to the nozzle axis, b) an unstable coating agent jet which disintegrates into coating agent droplets, c) a coating agent jet with an insufficient amount of coating agent, d) a disturbed coating agent jet, e) a missing coating agent jet due to clogging of the nozzle.

19. Coating installation for coating components with a coating agent, comprising:

a) a nozzle applicator having at least one nozzle for dispensing a coating agent jet of the coating agent onto the component to be coated, b) means for preventing nozzle clogging, the means for preventing nozzle including a filter upstream of the nozzle for filtering the coating agent, c) the coating agent flows through the filter in a normal flow direction during coating operation, and d) the coating installation is adapted so that the filter can be flushed in the normal flow direction with a flushing agent, so that the flushing agent flows through the filter in the normal flow direction.

20. The coating installation according to claim 19, wherein a) the coating installation comprises a flushing agent port for supplying said flushing agent, and b) the coating installation has a return port for returning a mixture of coating agent and flushing agent to a return, and c) the coating installation comprises a flushing valve arrangement for selectively passing the flushing agent through the filter in the normal flow direction or against the normal flow direction.

21. The coating installation according to claim 19, wherein a) the filter is a double filter having two individual filters which are arranged parallel to one another, b) the coating agent is passed by a selection valve arrangement selectively into one individual filter or into the other individual filter, c) the flushing agent is passed by the selection valve arrangement selectively either into one individual filter or into the other individual filter, and d) one individual filter is flowed through by the flushing agent, while the other individual filter is flowed through by the coating agent.

22. The coating installation according to claim 19, wherein the filter is arranged between a metering pump and the nozzle applicator.

23. The coating installation according to claim 22, wherein the filter is arranged upstream of the metering pump.

24. The coating installation according to claim 19, wherein a) the coating installation has a colour changer which selects a desired coating agent from a plurality of coating agent supply lines and forwards it to the nozzle applicator, b) a respective filter is arranged in the coating agent feed lines upstream of the colour changer.

25. The coating installation according to claim 24, wherein the filters at the input of the colour changer are different and adapted to the respective coating agent.

26. The coating installation according to claim 19, wherein the filter has internal contours which are free of undercuts.

27. The coating installation according to claim 19, wherein the filter has internal surfaces with a roughness number $Rz<10$.

28. The coating installation according to claim 19, wherein the nozzle has a nozzle diameter of less than 1 mm.

29. Coating installation for coating components with a coating agent, comprising:

a) a nozzle applicator having at least one nozzle for dispensing a coating agent jet of the coating agent onto the component to be coated, b) means for preventing nozzle clogging, the means for preventing nozzle clogging including a filter upstream of the nozzle for filtering the coating agent, c) the coating agent flows through the filter in a normal flow direction during coating operation, and d) the coating installation is adapted so that the filter can be flushed with a flushing agent against the normal flow direction, so that the flushing agent flows through the filter against the normal flow direction.

30. The coating installation according to claim 29, wherein a) the coating installation comprises a flushing agent port for supplying said flushing agent, and b) the coating installation has a return port for returning a mixture of coating agent and flushing agent to a return, and c) the coating installation comprises a flushing valve arrangement for selectively passing the flushing agent through the filter in the normal flow direction or against the normal flow direction.

31. The coating installation according to claim 29, wherein a) the filter is a double filter having two individual filters which are arranged parallel to one another, b) the coating agent is passed by a selection valve arrangement selectively into one individual filter or into the other individual filter, c) the flushing agent is passed by the selection valve arrangement selectively either into one individual filter or into the other individual filter, and d) one individual filter is flowed through by the flushing agent, while the other individual filter is flowed through by the coating agent.

32. The coating installation according to claim 29, wherein the filter is arranged between a metering pump and the nozzle applicator.

33. The coating installation according to claim 32, wherein the filter is arranged upstream of the metering pump.

34. The coating installation according to claim 29, wherein a) the coating installation has a colour changer which selects a desired coating agent from a plurality of coating agent supply lines and forwards it to the nozzle applicator, b) a respective filter is arranged in the coating agent feed lines upstream of the colour changer.

35. The coating installation according to claim 34, wherein the filters at the input of the colour changer are different and adapted to the respective coating agent.

36. The coating installation according to claim 29, wherein the filter has internal contours which are free of undercuts.

37. The coating installation according to claim 29, wherein the filter has internal surfaces with a roughness number Rz<10.

38. The coating installation according to claim 29, wherein the nozzle has a nozzle diameter of less than 1 mm.

* * * * *